US007278265B2

(12) United States Patent
Alvin et al.

(10) Patent No.: US 7,278,265 B2
(45) Date of Patent: Oct. 9, 2007

(54) CATALYTIC COMBUSTORS

(75) Inventors: Mary Anne Alvin, Pittsburgh, PA (US); Basil Mucha, Wayne, PA (US); James Klotz, Quakertown, PA (US)

(73) Assignee: Siemens Power Generation, Inc., Orlando, FL (US)

( * ) Notice: Subject to any disclaimer, the term of this patent is extended or adjusted under 35 U.S.C. 154(b) by 725 days.

(21) Appl. No.: 10/672,772

(22) Filed: Sep. 26, 2003

(65) Prior Publication Data

US 2005/0066663 A1 Mar. 31, 2005

(51) Int. Cl.
*F23C 13/08* (2006.01)

(52) U.S. Cl. ..... 60/723; 106/287.17; 502/439

(58) Field of Classification Search ..... 60/723; 437/7, 268; 106/287.17; 502/439; 431/7, 431/268

See application file for complete search history.

(56) References Cited

U.S. PATENT DOCUMENTS

| | | | | |
|---|---|---|---|---|
| 3,231,520 | A | 1/1966 | Leak et al. | |
| 3,362,783 | A | 1/1968 | Leak | |
| 3,923,696 | A | 12/1975 | Chart et al. | |
| 4,254,739 | A | 3/1981 | Enga | |
| 4,601,999 | A | 7/1986 | Retallick et al. | |
| 4,762,567 | A | 8/1988 | Retallick | |
| 4,870,824 | A | 10/1989 | Young et al. | |
| 5,232,357 | A | 8/1993 | Dalla Betta et al. | |
| 5,250,489 | A | 10/1993 | Dalla Betta et al. | |
| 5,288,470 | A | 2/1994 | Cornelison et al. | |
| 5,577,906 | A | 11/1996 | Hanakata et al. | |
| 6,015,285 | A | 1/2000 | McCarty et al. | |
| 6,272,863 | B1 | 8/2001 | Pfefferle et al. | |
| 6,358,040 | B1 * | 3/2002 | Pfefferle et al. | 431/7 |
| 6,415,608 | B1 | 7/2002 | Newburry | |
| 6,752,623 | B2 * | 6/2004 | Smith et al. | 431/170 |
| 7,147,947 | B2 * | 12/2006 | Wu et al. | 429/17 |

FOREIGN PATENT DOCUMENTS

GB 2 303 439 A 2/1997

OTHER PUBLICATIONS

U.S. Appl. No. 09/965,573, filed Sep. 27, 2001, Bruck et al.
U.S. Appl. No. 09/882,389, filed Mar. 30, 2001, Alvin.
U.S. Appl. No. 09/965,557, filed Sep. 27, 2001, Bruck et al.

* cited by examiner

*Primary Examiner*—Michael Koczo, Jr.

(57) ABSTRACT

A catalytic combustor for a combustion turbine that employs a protective nickel aluminide diffusion barrier on its inside and outside surfaces with a porous alumina, zirconia, titania, and/or ceria, and bond phase coating on the outside surface in which a catalyst is contained.

16 Claims, 4 Drawing Sheets

CATALYTIC COMBUSTORS

BACKGROUND OF THE INVENTION

1. Field of the Invention

The present invention relates generally to combustion gas turbine engines and, more particularly, to combustion gas turbine engines that employ catalytic combustion principles in the environment of a lean premix burner.

2. Related Art

As is known in the relevant art, combustion gas turbine engines typically include a compressor section, a combustor section and a turbine section. Large quantities of air or other gases are compressed in the compressor section and are delivered to the combustor section. The pressurized air in the combustor section is then mixed with fuel and combusted. The combustion gases flow out of the combustor section and into the turbine section where the combustion gases power a turbine and thereafter exit the engine. Commonly, the turbine section includes a shaft that drives the compressor section, and the energy of the combustion gases is greater than that required to run the compressor section. As such, the excess energy is taken directly from the turbine/compressor shaft to typically drive an electrical generator or may be employed in the form of thrust, depending upon the specific application and the nature of the engine.

As is further known in the relevant art, some combustion gas turbine engines employ a lean premix burner that mixes excess quantities of air with the fuel to result in an extremely lean-burn mixture. Such a lean-burn mixture, when combusted, beneficially results in the reduced production of nitrogen oxides ($NO_x$), which is desirable in order to comply with applicable emission regulations, as well as for other reasons.

The combustion of such lean mixtures can, however, be somewhat unstable and thus catalytic combustion principles have been applied to such lean combustion systems to stabilize the combustion process. Catalytic combustion techniques typically involve preheating a mixture of fuel and air and flowing the preheated mixture over a catalytic material that may be in the form of a noble metal such as platinum, palladium, rhodium, iridium or the like. When the fuel/air mixture physically contacts the catalyst, the fuel/air mixture spontaneously begins to combust. Such combustion raises the temperature of the fuel/air mixture, which in turn enhances the stability of the combustion process. The requirement to preheat the fuel/air mixture to improve the stability of the catalytic process reduces the efficiency of the operation. A more recent improvement splits the compressed air that ultimately contributes to the lean-burn mixture into two components; mixing approximately 10-20% with the fuel that passes over the catalyst while the remainder of the compressed air passes through a cooling duct, which supports the catalyst on its exterior wall. The rich fuel/air mixture burns at a much higher temperature upon interaction with the catalyst and the coolant air flowing through the duct functions to cool the catalyst to prevent its degradation. Approximately 20% of the fuel is burned in the catalytic stage and the fuel-rich air mixture is combined with the cooling gas just downstream of the catalytic stage and ignited in a second stage to complete combustion and form the working gas for the turbine section.

In previous catalytic combustion systems, the catalytic materials typically were applied to the outer surface of a ceramic substrate to form a catalytic body. The catalytic body was then mounted within the combustor section of the combustion gas turbine engine. Ceramic materials were often selected for the substrate in as much as the operating temperature of a combustor section typically can reach 1327° C. (2420° F.), and ceramics were considered as the best substrate for use in such a hostile environment, based on considerations of cost, effectiveness and other considerations. In some instances, the ceramic substrate was in the form of a ceramic wash coat applied to an underlying metal substrate, the catalyst being applied to the ceramic wash coat.

The use of such ceramic substrates for the application of catalytic materials has not, however, been without limitation. When exposed to typical process temperatures within the combustor section, the ceramic wash coat can be subjected to spalling and/or cracking due to poor adhesion of the ceramic wash coat to the underlying metal substrate and/or mismatch in the coefficients of thermal expansion of the two materials. Such failure of the ceramic wash coat subsequently reduces catalytic performance. It is thus desired to provide an improved catalytic body that substantially reduces or eliminates the potential for reduced catalytic performance due to use of ceramic materials.

In certain lean premix burner systems, such as the two-stage catalytic combustors described above, oxidation of the advanced nickel-based alloys, such as Haynes 230 and Haynes 214 commonly employed as the substrate for the ceramic wash coat, at temperatures of 900° C. (1650° F.), not only lead to the formation of either chromia- or alumina-enriched external oxide layer, but also to internal oxidation of the metal substrate. With time, the unaffected cross-sectional wall thickness area of the catalytic combustion substrate tubes decreases and gives rise to a potential reduction in the ultimate load-bearing capabilities of the substrate tube. It is thus desired that an improved catalytic body be provided, that can be used in conjunction with such a multistage combustor section without exhibiting such oxide degradation.

SUMMARY OF THE INVENTION

To achieve the foregoing objectives, this invention provides an improved catalyst module for a combustor that includes an elongated duct for carrying the cooling air internally and whose outer surface supports the catalyst layer. A coating or barrier layer material is bonded to the interior and/or exterior surfaces of the duct. The coating consists of fine aluminum particles in suspension which, when cured at high temperatures, forms a ceramacious (ceramic-like) coating. At curing, phase changes occur between the coating and substrate that form an additional internal diffusion barrier layer within the metal substrate. The primary function of the coating is to provide temperature, corrosion and oxidation resistance to the underlying metal substrate.

Preferably, the coating applied to the exterior of the duct is a less dense, porous, compositionally similar structure, within which the catalyst material is contained. The density of the non-catalytic coating applied, for example, to the inner surface of the tubes can be up to approximately between 10% to 50% denser and, preferably, 25% denser than the catalytic coating. The bi-functionality of the external coating serves as the catalytic matrix, as well as a temperature, corrosion and/or oxidation resistant coating, protecting the underlying metal substrate. In contrast, the denser coating applied to the internal surface of the duct provides temperature, corrosion and/or oxidative resistance to the underlying metal substrate.

In one embodiment, the surface of the metal substrate is roughened via mechanical abrasion before the coating is applied. This preparation provides a strong mechanical or interlocking bond, and enhances subsequent chemical bonding between the applied coating and metal substrate. In a second embodiment, limited high temperature oxidation and/or etching are used to prepare the surface of the metal substrate for coating application.

BRIEF DESCRIPTION OF THE DRAWINGS

A further understanding of the invention can be gained from the following description of the preferred embodiments when read in conjunction with the accompanying drawings in which.

DETAILED DESCRIPTION OF THE PREFERRED EMBODIMENT

The preferred embodiment of this invention is a catalyst supporting structure for a catalytic combustor. The catalyst supporting structure provides for improved bonding of the catalyst-containing coating with the underlying metal substrate, and renders the metal support structure resistant to oxidation that would otherwise degradate the support capability of the structure over time.

Figure 1:
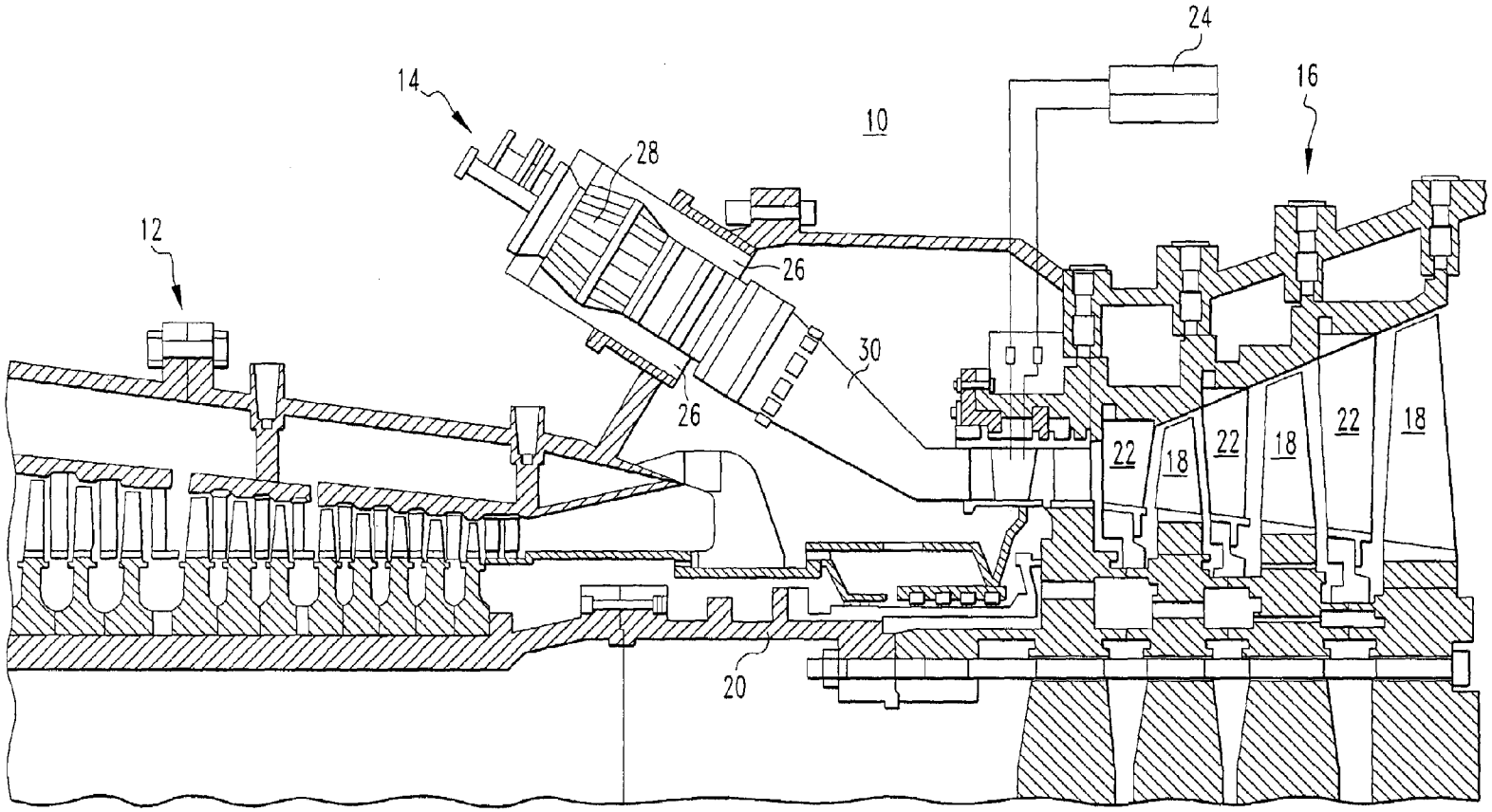
FIG. 1 is a cross-sectional view of a combustion turbine for which a catalytic combustor of the present invention will be used.

FIG. 1 illustrates a combustion turbine 10. The combustion turbine 10 includes a compressor section 12, at least one combustor 14, and a turbine section 16. The turbine section 16 includes a plurality of rotating blades 18, secured to a rotatable central shaft 20. A plurality of stationery vanes 22 are positioned between the blades 18, with the vanes 22 being dimensioned and configured to guide a working gas over the blades 18.

In use, air is drawn in through the compressor 12, where it is compressed and driven towards the combustor 14, with the air entering through air intake 26. From the air intake 26, the air will typically enter the combustor at combustor entrance 28, wherein it is mixed with fuel. The combustor 14 ignites the fuel/air mixture, thereby forming a working gas. This working gas will typically be approximately 1371° C. to 1593° C. (2500° F. to 2900° F.). The working gas expands through the transition member 30, through the turbine 16, being guided across the blades 18 by the vanes 22. As the gas passes through the turbine 16, it rotates the blades 18 and shaft 20, thereby transmitting usable mechanical work through the shaft 20. The combustion turbine 10 also includes a cooling system 24 dimensioned and configured to supply a coolant, for example, steam or compressed air, to the blades 18, vanes 22 and other turbine components.

Figure 2:
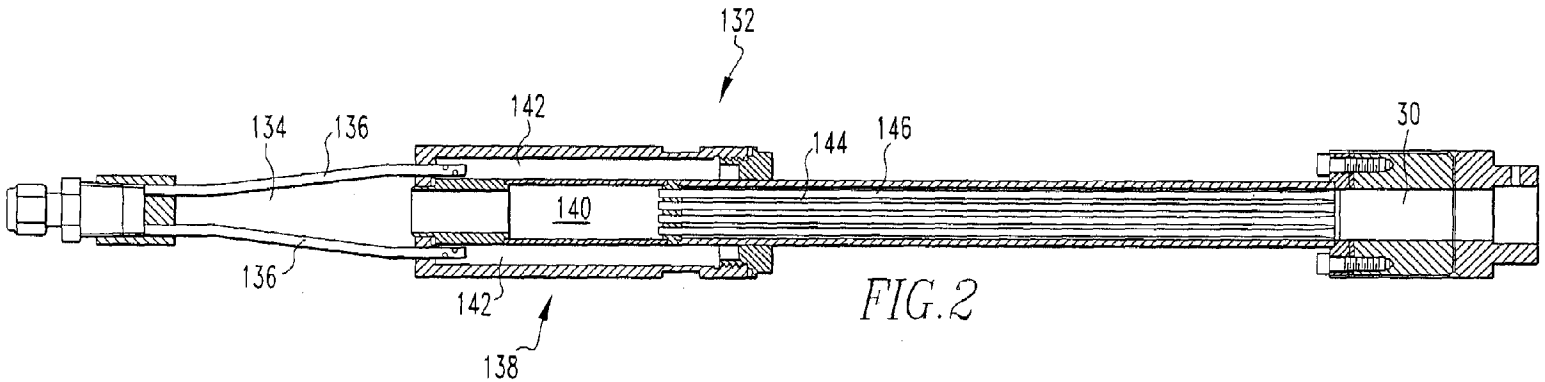
FIG. 2 is a side cross-sectional view of one embodiment of a catalytic combustor according to the present invention.
Figure 3:
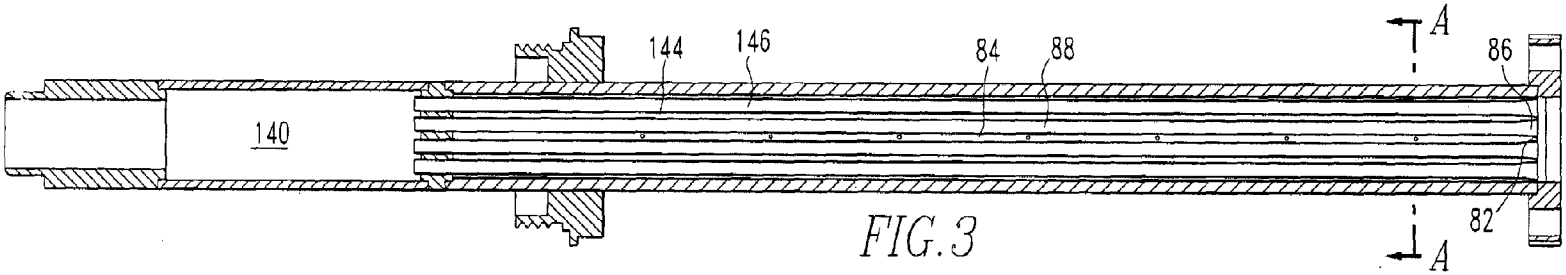
FIG. 3 is a cross-sectional side view of the catalytic combustor embodiment of FIG. 2, focusing on the catalyst supporting tubes.

FIGS. 2 and 3 illustrate one embodiment of a catalytic assembly portion of a catalytic combustor. In the following description, two digit numbers refer to the general components in the various figures and three digit numbers refer to the component of a specific embodiment. The catalytic assembly portion 132 includes an air inlet 134 and a fuel inlet 136. The fuel and air are directed from the air inlet 134 and fuel inlet 136 into a mixer/separator chamber 138. A portion of the air becomes the cooling air, traveling through the central cooling air passage 140. The remaining air is directed towards the exterior mixing chamber 142, wherein it is mixed with fuel from the fuel nozzles 136. The catalyst-coated channels 144 and cooling air channels 146 are located downstream of the mixer/separator portion 138, with the catalyst-coated channels 144 in communication with the mixing chambers 142 and the uncoated cooling channels 146 in communication with the cooling air chamber 140. A fuel-rich mixture is thereby provided to the catalyst-coated channels, resulting in a reaction between the fuel and catalyst without a preburner, and heating the fuel/air mixture. Upon exiting the catalyst-coated channels 144 and cooling channels 146, the fuel/air mixture and cooling air mix within the transition member 30, thereby providing a fuel-lean mixture at the point of ignition expanding towards the turbine blades as the fuel/air mixture is ignited and burned in the second stage.

Referring to FIG. 3, the end portions 86 of the tubular assemblies 146 are flared with respect to the central portion 88 of the tubular assembly 146. An alternate preferred embodiment described in U.S. patent application Ser. No. 10/319,006, filed Dec. 13, 2002, "Catalytic Oxidation Module for a Gas Turbine—Bruck et al., teaches the use of non-flared tubes. This channel profile provides for sufficient flow of the fuel/air mixture to prevent backflash (premature ignition of fuel in the combustor).

The alternating channels are configured so that one set of channels will include a catalytic surface coating, and the adjacent set of channels will be uncoated, thereby forming channels for cooling air adjacent to the catalyst-coating channels. These alternating channels may be formed by applying the catalytic coating to either the inside surface or the outside surface of tubular subassemblies. One preferred embodiment described in U.S. patent application Ser. No. 09/965,573, filed on Sep. 27, 2001, applies the catalytic coating to the outside surfaces of the top and bottom of each rectangular, tubular subassembly, which are then stacked in a spaced array, so that the catalyst-coated channels 144 are formed between adjacent, rectangular, tubular subassemblies, and the cooling air channels are formed within the rectangular, tubular subassemblies. Some preferred catalyst materials include platinum, palladium, ruthenium, rhodium, osmium, iridium, titanium dioxide, cerium oxide, zirconium oxide, vanadium oxide and chromium oxide.

Referring to FIGS. 2 and 3, in use, air exiting the compressor 12 (FIG. 1) will enter the air intake 26, proceeding to the air inlet 134 shown in FIG. 2. The air will then enter the cooling air plenum 140, with some air entering the cooling channels or ducts 146, and another part of the air entering the mixing chamber 142, wherein it is mixed with fuel from the fuel inlet 136. The fuel/air mixture will then enter the catalyst-coated channels 144. The fuel/air mixture may enter the catalyst-coated channels 144 in a direction perpendicular to the elongated dimension of these channels, turning downstream once it enters the catalyst-coated channels 144. The catalyst will react with the fuel, heating the fuel/air mixture. At the air outlet 30, the fuel/air mixture and cooling air will mix, the fuel will be ignited, and the fuel/air mixture will then expand into the blades 18 of the turbine 16 shown in FIG. 1.

Figure 4:
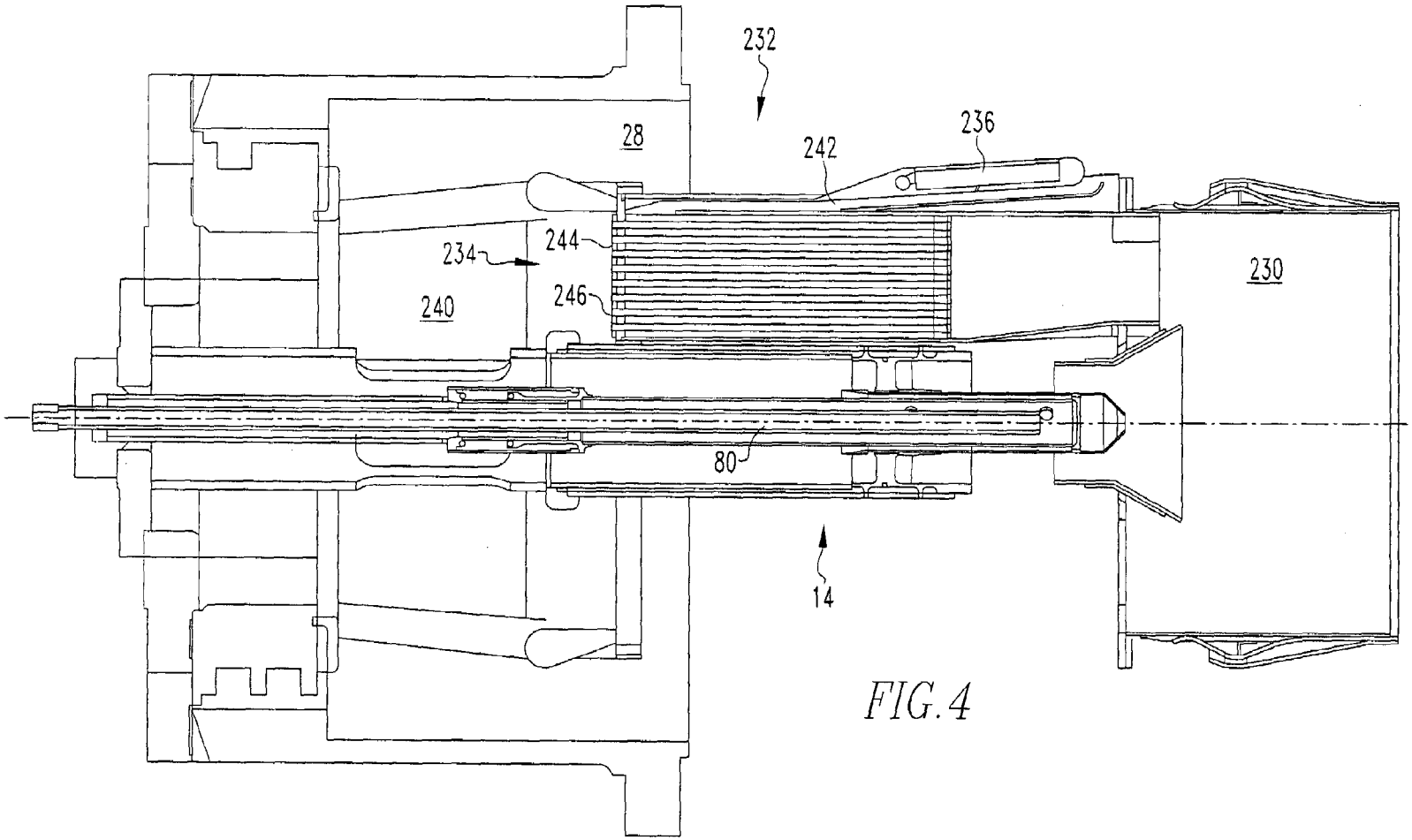
FIG. 4 is a side cutaway view of another embodiment of a catalytic combustor according to the present invention.

Referring to FIG. 4, a second embodiment of the catalytic combustor 14 is illustrated, which shows the catalyst assembly 232 housed in an environment of a two-stage combustor 14. The catalytic assembly portion 232 includes an air inlet 234, and a fuel inlet 236. Pilot nozzle 80 passes axially through the center of the combustor 14, serving as both an internal support and as an ignition device at the transition member 230. In the embodiment shown in FIG. 4, a portion of the air is separated to become cooling air and travels through the cooling air passage to the plenum 240. The remaining air is directed towards the mixing plenum 242 wherein it is mixed with fuel provided by the fuel inlet 236. The catalyst-coated channels 244 are in communication with the mixing plenums 242 and the uncoated cooling channels 246 are in communication with the cooling air plenum 240. The fuel/air mixture may enter the catalyst-coated channels 244 in a direction substantially perpendicular to these channels, turning downstream once the fuel/air mixture enters the catalyst-coated channels 244. A fuel-rich mixture is thereby provided to the catalyst-coated channels, resulting in a reaction between the fuel and catalyst without a preburner, and heating the fuel/air mixture. Upon exiting the catalyst-coated channels 244 and cooling channels 246, the fuel/air mixture and the cooling air mix within the transition member 230, thereby providing a fuel-lean mixture at the point of ignition, expanding towards the turbine blades as the fuel-lean mixture is ignited and burned. In a typical prior art first stage catalytic combustor, the catalyst is supported along a ceramic wash coat layer that is deposited along the outer surface of a 4.76 mm (0.19 in.) diameter, approximately 250 micrometer thick metal tubes typically constructed from Haynes alloys 214 or 230, a product of Haynes International, Inc., headquartered in Kokomo, Ind. Compressor discharge air is introduced into the module at temperatures of approximately 375° C.-410° C. (710° F.-770° F.). 80-90%of the compressor air is channeled along the inside diameter bore or uncoated surface of the catalytic combustion tubes, while 10-20% of the compressor air combines with the incoming fuel. The rich fuel/air mixture passes over the outside diameter catalytically-coated surface of the tubes, initiating light-off at temperatures of between 290° C. and 360° C. (555° F.-680° F.), achieving partial combustion, i.e., 10-20% of the fuel. The air, which is introduced along the inside diameter bore of the tubes, cools and maintains the catalytic reaction temperature. Under rich fuel conditions, temperatures of 760° C.-870° C. (1400° F.-1600° F.) are typically achieved at the outlet of the first stage catalytic combustor. Air flowing along the inside diameter surface of the tubes then combines with the partially converted, fuel-rich process gas, producing a fuel-lean gas composition. The fuel-lean gas mixture raises the exhaust gas temperature to 1260° C. to 1480° C. (2300° F. -2700° F.), while achieving complete fuel conversion to a working gas to drive the turbine section 16 through 100% combustion.

Figure 5:
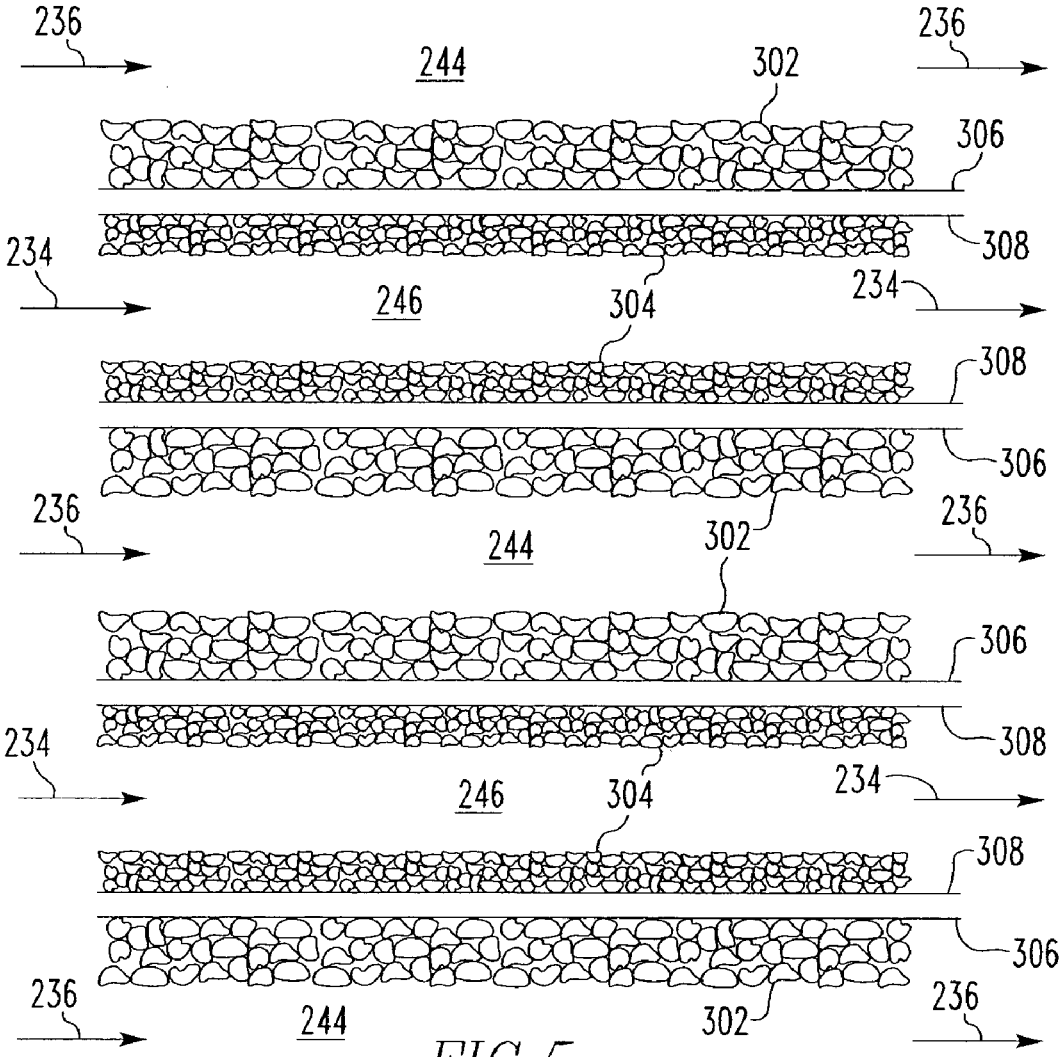
FIG. 5 is a schematic view of a catalytic section of a combustor illustrating the coating on the metal substrate.

Tests have shown that oxidation of the advanced nickel-based alloys such as Haynes 230 and Haynes 214 at temperatures of 900° C. (1650° F.) will not only lead to the formation of either a chromia- or alumina-enriched external oxide layer, but also to internal oxidation of the metal substrate. With time, the unaffected cross-sectional wall thickness area of the catalytic combustion substrate tubes decreased, likely resulting in a reduction in the ultimate load-bearing capabilities of the substrate tube. In order to prevent surface oxidation, internal metal wall oxidation, and a possible reduction of the load-bearing area of the catalytic combustion support tubes from occurring, this invention applies a coating to the walls of the cooling air channel, which is preferably, but not required to be, the inside diameter surface of the tubes, which is in direct contact with the flowing air (FIG. 5).

The primary function of the coating 304 along the inside surface 308 of the tube, rectangular assembly, or duct (FIG. 5), is protection of the metal substrate from both surface and internal oxidation during process operation. The coating structure achieves an internal diffusion barrier zone within the metal substrate inherently by aluminizing the substrate metal through the molecular interaction of nickel and other elements from within the Haynes 230 or Haynes 214 substrate with aluminum from the applied coating. This interaction forms a complex nickel aluminide zone at the metal substrate/coating interface. This dense zone provides exceptional thermal and oxidative protection to the substrate metal.

Compositionally similar to the coating applied to the inside surface 308 of the tube, rectangular assembly, or duct, the coating 302 applied to the external surface 306 of said components (FIG. 5), within the cross-sectional thickness of the applied coating, is a porous structure. This porous, matrix-like structure can contain suspended metal or reduced catalyst species. The catalyst species include, but are not limited to the use of Pt, Pd, Ir, Ru, Rh, Os and the like, formed through the addition of metal nanoparticles, and/or through the reduction/dissociation of chloride, nitrate, amine, phosphate, and the like, precursor phases. This coating is both chemically and mechanically adhered to the metal substrate. It is inorganic and can also contain various alloying oxides such as, but not limited to, alumina, titania, zirconia, ceria and so on. These alloying materials can be used to modify other properties of the coating such as catalytic activity, ductility, conductivity, etc. An aluminum-containing coating that can be used for this purpose is a chrome-phosphate-bonded aluminum coating, available from Coating Technology, Inc., Malvern, Pa., and Coatings for Industry, Inc., Souderton, Pa. Preferably, the base metal of the tubes rectangular assemblies or ducts are either lightly abraded prior to application of the coating to provide microscopic ridges and valleys for enhanced mechanical interlocking of the applied coating layer, or oxidized to initiate the formation of a non-smooth chromia-alumina-enriched surface layer. In this manner, the applied diffusion barrier coating is considered to have a two-fold advantage over that of the current ceramic wash coat technology. First of all, the diffusion barrier coating reduces the surface metal and/or internal wall oxidation. Secondly, the coating's inherent bonding to the underlying substrate is both mechanical as well as chemical in nature, and provides a much stronger attachment than that of the ceramic wash coat. Additionally, there is a third advantage in that the aluminum-enriched matrix formed throughout the coating is capable of serving as a porous substrate on or into which the catalyst is introduced. Additionally, a more densified diffusion barrier coating is applied to the inside diameter surface of the catalytic combustion tube than is applied to the outside surface of the tube. Densification can be achieved through the use of a finer particle size or higher loading of metal and/or ceramic or metal oxide particles, thus reducing open porosity within the applied diffusion barrier layer. The resulting densified layer limits oxygen diffusion to the metal substrate, protecting the cooling air channels from oxidation. The density of the non-catalytic coating can be approximately between 10% to 50% denser and preferably 25% denser than the catalytic coating.

While specific embodiments of the invention have been described in detail, it will be appreciated by those skilled in the art that various modifications and alternatives to those details could be developed in light of the overall teachings of the disclosure. For example, the catalyst described as being applied to the outside diameter surface of the catalytic tubes could be applied instead to the inside diameter surface with the cooling air passing over the outside diameter surface. Additionally, the terms "tubes" and "channels" have been used interchangeably and shall also encompass ducts or other conduits of any geometric shape that can be employed for the foregoing described purpose. Accordingly, the particular embodiments disclosed are meant to be illustrative only and not limiting as to the scope of the invention, which is to be given the full breath of the appended claims and any and all equivalents thereof.

What is claimed is:

1. A combustor having a catalyst module comprising at least one duct with a first and second flow path, the first flow path on the inside of the duct along an inside wall thereof and the second flow path on the outside of the duct along at least one outside wall thereof, both the inside wall and outside wall of the duct being lined with a barrier layer and one or the other of the inside wall or outside wall has a catalyst coating over at least part of the barrier layer, wherein the barrier layer is a NiAl zone.

2. The combustor of claim 1 wherein the barrier containing the catalyst is less dense than the barrier on the other side of the duct wall.

3. The combustor of claim 2 wherein the barrier layer on the other side of the duct wall is approximately between 10% to 50% denser than the barrier layer containing the catalyst.

4. The combustor of claim 3 wherein the barrier layer on the other side of the duct wall is up to approximately between 10% to 50% denser than barrier layer containing the catalyst.

5. The combustor of claim 4 wherein the barrier layer on the other side of the duet wall is up to approximately 25% denser than the barrier layer containing the catalyst.

6. The combustor of claim 1 wherein the barrier layer that interfaces with the catalyst is porous throughout the layer.

7. The combustor of claim 6 wherein the barrier layer containing the catalyst also has an alumina, zirconia, titania, and/or ceria, and an inorganic bond phase coating on an outside surface that supports the catalyst.

8. The combustor of claim 1 wherein the barrier layer is both chemically and mechanically bonded to a substrate.

9. The combustor of claim 8 wherein the barrier layer contains an alumina and an inorganic bond phase coating on the inside surface of the tube that becomes part of the substrate.

10. The combustor of claim 1 wherein the duct is a tube.

11. A catalytic combustor duct having an inside surface and an outside surface with both of the inside surface and outside surface being lined with a barrier layer and one or the other of said inside surface or outside surface having a catalyst coating over or through at least part of the barrier layer, wherein the duct is a tube.

12. The combustor duct of claim 8 wherein the barrier layer is a NiAl zone.

13. The combustor duct of claim 12 wherein the barrier containing the catalyst is less dense than the barrier on the other surface of the duct.

14. The combustor duct of claim 12 wherein the barrier layer that interfaces with the catalyst is porous.

15. The combustor duct of claim 14 wherein a diffusion barrier layer underlying the catalyst has an alumina, zirconia, titania, and/or ceria, and an inorganic bond phase coating on an outside surface that interfaces with the catalyst.

16. The combustor duct of claim 8 wherein a diffusion barrier layer is both chemically and mechanically bonded to a substrate.

* * * * *